US009732695B2

(12) United States Patent
Sanborn et al.

(10) Patent No.: US 9,732,695 B2
(45) Date of Patent: Aug. 15, 2017

(54) METHOD AND SYSTEM FOR SUPPLYING FUEL TO AN ENGINE

(71) Applicant: Ford Global Technologies, LLC, Dearborn, MI (US)

(72) Inventors: Ethan D. Sanborn, Saline, MI (US); Xiaoying Zhang, Dearborn Heights, MI (US); Joseph Lyle Thomas, Kimball, MI (US); Marcus William Fried, Farmingron Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 82 days.

(21) Appl. No.: 14/716,090

(22) Filed: May 19, 2015

(65) Prior Publication Data

US 2016/0341143 A1 Nov. 24, 2016

(51) Int. Cl.

| | |
|---|---|
| ***F02D 41/00*** | (2006.01) |
| ***F02D 41/30*** | (2006.01) |
| ***F02D 41/04*** | (2006.01) |
| *F02D 41/14* | (2006.01) |

(52) U.S. Cl.

CPC ..... *F02D 41/3094* (2013.01); *F02D 41/047* (2013.01); *F02D 2041/1432* (2013.01)

(58) Field of Classification Search

CPC ..... F02D 41/3094

See application file for complete search history.

(56) References Cited

U.S. PATENT DOCUMENTS

| | | | | |
|---|---|---|---|---|
| 5,642,722 | A | 7/1997 | Schumacher et al. | |
| 6,003,478 | A * | 12/1999 | Huber | F02B 7/06 123/27 GE |
| 6,644,286 | B2 | 11/2003 | Kapolnek et al. | |
| 7,426,918 | B2 | 9/2008 | Brehob et al. | |
| 7,546,834 | B1 * | 6/2009 | Ulrey | F02D 19/0628 123/525 |
| 7,640,914 | B2 * | 1/2010 | Lewis | F02D 41/0025 123/431 |
| 7,647,916 | B2 * | 1/2010 | Leone | F02M 26/01 123/25 E |
| 8,353,269 | B2 * | 1/2013 | Kasseris | F02B 47/04 123/198 A |
| 9,435,288 | B2 * | 9/2016 | Cohn | F02D 41/3094 |
| 2007/0089697 | A1 * | 4/2007 | Hara | F02D 35/023 123/90.15 |
| 2011/0162620 | A1 * | 7/2011 | Bidner | F02D 41/0025 123/299 |

OTHER PUBLICATIONS

Glugla, C. et al., "Method of Fuel Injection for a Variable Displacement Engine," U.S. Appl. No. 14/294,035, filed Jun. 6, 2014, 54 pages.

* cited by examiner

*Primary Examiner* — Hieu T Vo
*Assistant Examiner* — Sherman Manley
(74) *Attorney, Agent, or Firm* — Julia Voutyras; McCoy Russell LLP

(57) ABSTRACT

Methods and systems are presented for adjusting an amount of fuel supplied to an engine via port and direct fuel injectors during transient engine operating conditions where the fuel injection amount is adjusted responsive to the transient engine operating conditions. In one example, a fuel injection amount is adjusted based on a time constant for a filter that is based on a direct fuel injection fuel fraction.

14 Claims, 5 Drawing Sheets

200

| ENGINE SPEED | 0 | 0.2 | 0.4 | 0.6 | 0.8 | 1.2 |
|---|---|---|---|---|---|---|
| 6000 | 0.8,0.2 | 0.8,0.2 | 0.8,0.2 | 0.8,0.2 | 0.8,0.2 | 0.8,0.2 |
| 5000 | 0.6,0.4 | 0.2,0.8 | 0.3,0.7 | 0.4,0.6 | 0.5,0.5 | 0.6,0.4 |
| 4000 | 0.3,0.7 | 0.1,0.9 | 0.1,0.9 | 0.2,0.8 | 0.2,0.8 | 0.3,0.7 |
| 3000 | 0.3,0.7 | 0.2,0.8 | 0,1 | 0,1 | .05,.95 | 0.1,0.9 |
| 2000 | 0.7,0.3 | 0.4,0.6 | 0,1 | 0,1 | 0,1 | 0.1,0.9 |
| 1000 | 0.9,0.1 | 0.7,0.3 | 0.5,0.5 | 0.3,0.7 | 0.2,0.8 | 0.1,0.9 |
| 0 | 1,0 | 0.8,0.2 | 0.8,0.2 | 0.5,0.5 | 0.2,0.8 | 0.2,0.8 |

ENGINE LOAD

FIG. 2

METHOD AND SYSTEM FOR SUPPLYING FUEL TO AN ENGINE

FIELD

The present description relates generally to methods and systems for supplying transient fuel for an engine that includes port and direct fuel injectors. Transient fuel relates to adjusting fuel amounts delivered to engine cylinders based on fuel puddle formation and fuel puddle dispersal so that a desired amount of fuel may be combusted in the engine cylinders.

BACKGROUND/SUMMARY

Port fuel injectors and direct fuel injectors each have advantages and disadvantages for injecting fuel to an engine. For example, port fuel injectors may provide lower engine emissions at lower engine temperatures. On the other hand, direct fuel injectors may provide improved air-fuel ratio control, thereby improving vehicle emissions during warm engine operating conditions. By combining port fuel injectors with direct fuel injectors, it may be possible to leverage advantages of both types of fuel injectors.

A desired amount of fuel injected to an engine cylinder during an engine cycle (e.g., four strokes) may be allocated between port fuel injectors and direct fuel injectors. The allocation of fuel to each type of fuel injector may be referred to as a fuel fraction or a percentage of a total amount of fuel injected during the engine cycle via the respective port and direct fuel injectors. For example, 20% or 0.2 of a total amount of fuel supplied to an engine or cylinder during a cylinder cycle, or a 20% direct fuel injector fuel fraction, may be delivered via direct fuel injectors. The remaining 80%, or an 80% port fuel injector fuel fraction, may be delivered to the engine or cylinder via port fuel injectors. Thus, the direct fuel injectors supply a 20% fraction of fuel supplied during the cylinder cycle, and the port fuel injectors supply an 80% fraction of fuel supplied during cylinder cycle. The directly injected fuel fraction and the port injected fuel fraction may vary with engine operating conditions such as engine speed and engine load or intake manifold pressure. However, fuel puddles may form in cylinder intake ports when fuel is supplied by port injectors. Further, fuel puddles may form within a cylinder due to injecting fuel via direct injectors during some conditions. The mass of fuel puddles may increase or decrease during transient conditions leading to engine air-fuel ratio errors as the fuel puddles expand and contract due to engine operating conditions. Therefore, it may be desirable to provide a way of compensating for the formation and/or dispersal of fuel puddles for an engine that includes both port and direct fuel injectors.

The inventors herein have recognized the above-mentioned issue and have developed an engine fueling method, comprising: retrieving engine operating information from sensors; adjusting a direct fuel injection fuel fraction of a total amount of fuel injected to a cylinder based on the engine operating information; filtering the direct fuel injection fuel fraction; and adjusting an amount of fuel injected to the cylinder in response to a difference between the direct fuel injection fuel fraction and the filtered direct fuel injection fuel fraction.

By filtering a direct fuel injection fraction, it may be possible to provide the technical result of improved transient fuel control during conditions where an injected amount of fuel is varied in response to conditions that may increase or decrease mass of one or more fuel puddles in an engine. The transient fuel adjustment may decrease an amount of fuel injected when it is expected that fuel in a puddle is dispersed and combusted in an engine cylinder. The transient fuel adjustment may increase an amount of fuel injected when it is expected that fuel in the puddle is increasing instead of entering a cylinder and participating in combustion within the cylinder. The increase or decrease in amount of fuel injected may be adjusted based on a direct fuel injector fuel fraction so that changes in proportion of fuel injected by direct and/or port injectors is compensated. The compensation operates to provide an amount of fuel in a cylinder that is equivalent to a desired cylinder fuel amount, even when fuel puddle size is increasing or decreasing.

The present description may provide several advantages. In particular, the approach may improve vehicle air-fuel ratio control. Additionally, the approach may be integrated with existing transient fuel control strategies to reduce development costs. Further, the approach may provide both gain and time constant adjustments based on a direct injector fuel fraction so that even if a total mass of fuel injected to the engine does not increase, fuel amounts provided to direct and port injection fuel injectors may be adjusted to account for puddles of fuel related to port and direct fuel injection.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 2 shows an example table of empirically determined port and direct fuel fractions;

DETAILED DESCRIPTION

Figure 1:
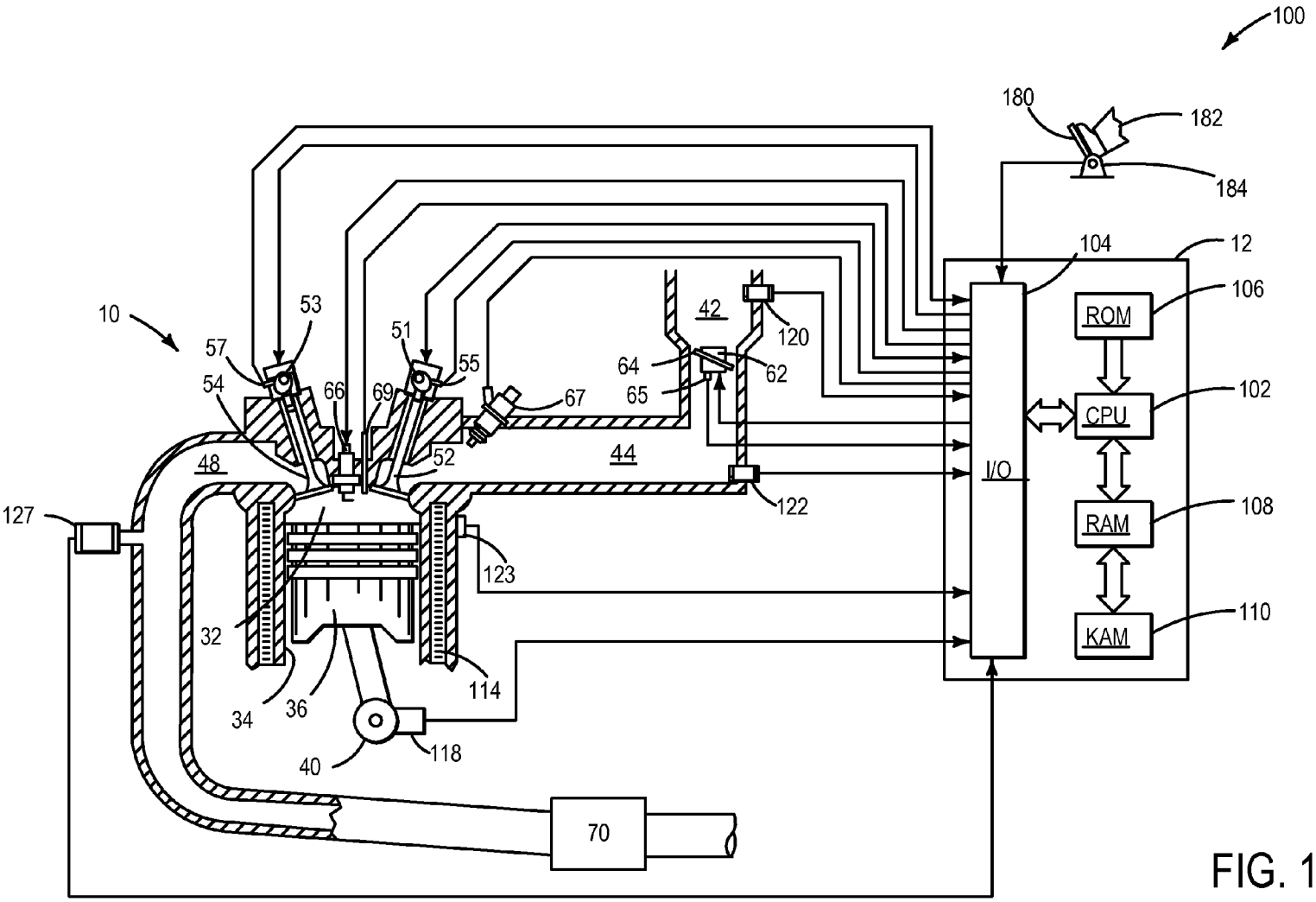
FIG. 1 is a schematic diagram of an example engine.
Figure 3:
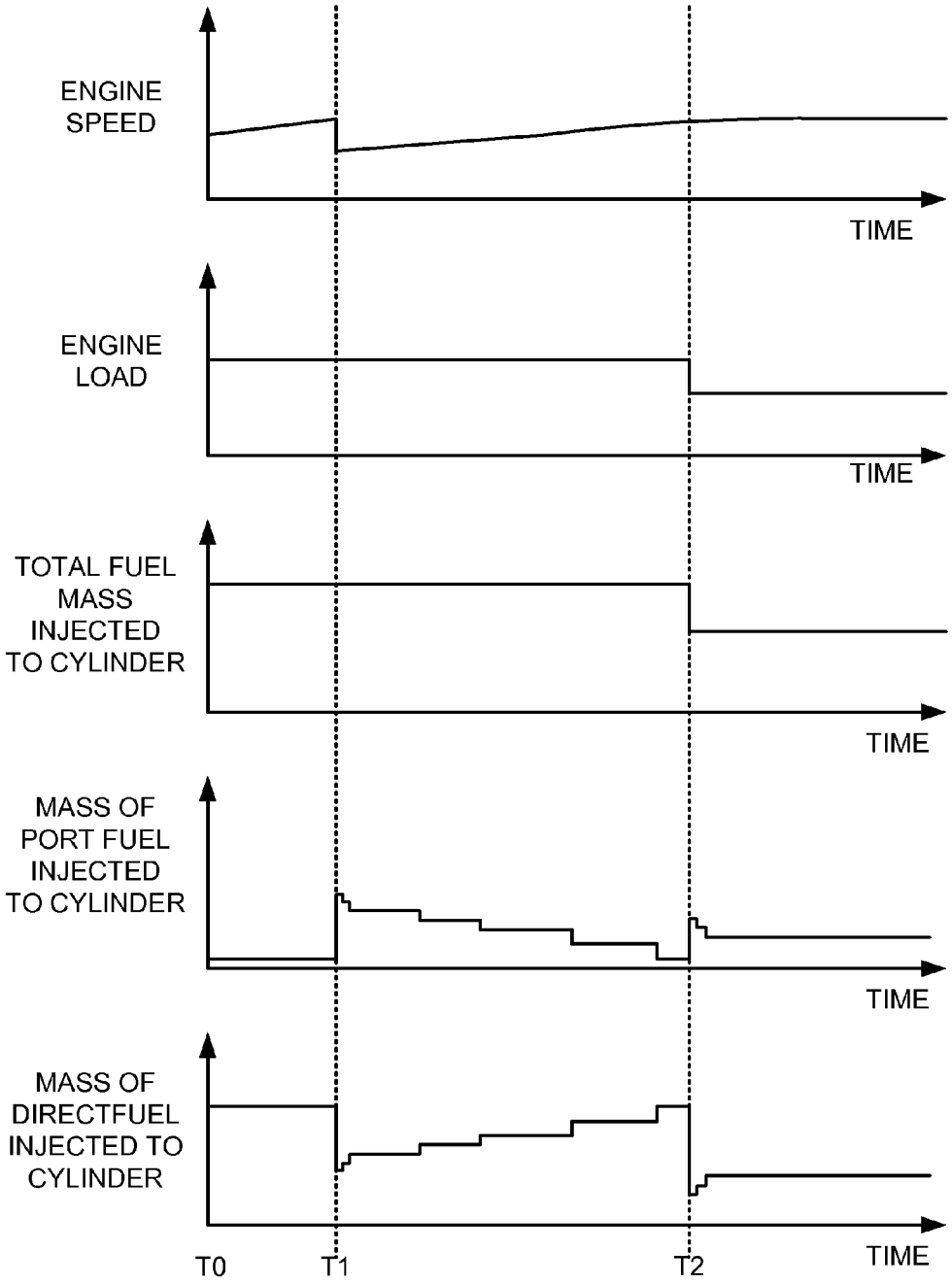
FIG. 3 shows a simulated example engine operating sequence according to the method of FIG. 5.
Figure 4:
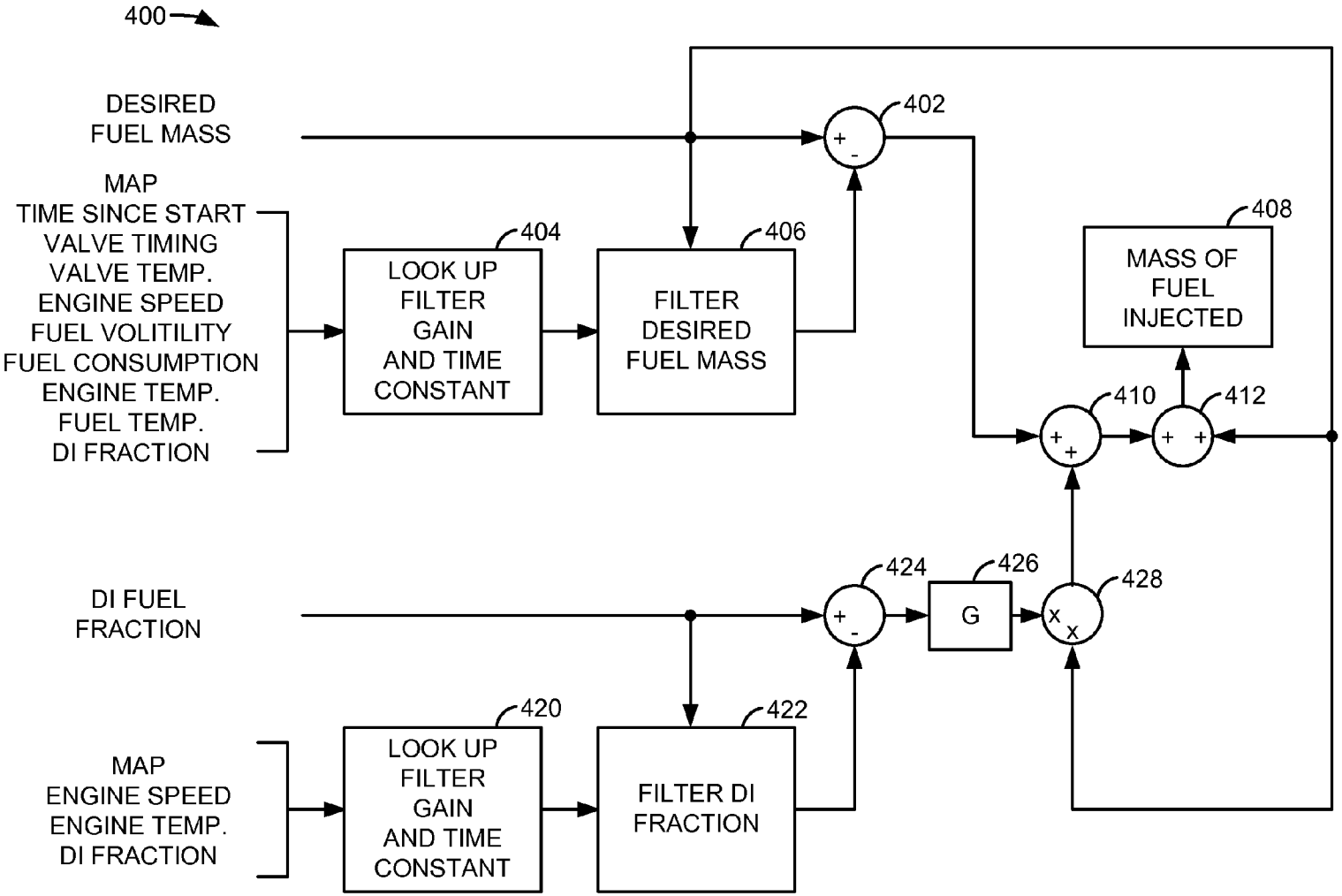
FIG. 4 shows a control system block diagram for adjusting fuel during transient engine operating conditions.
Figure 5:
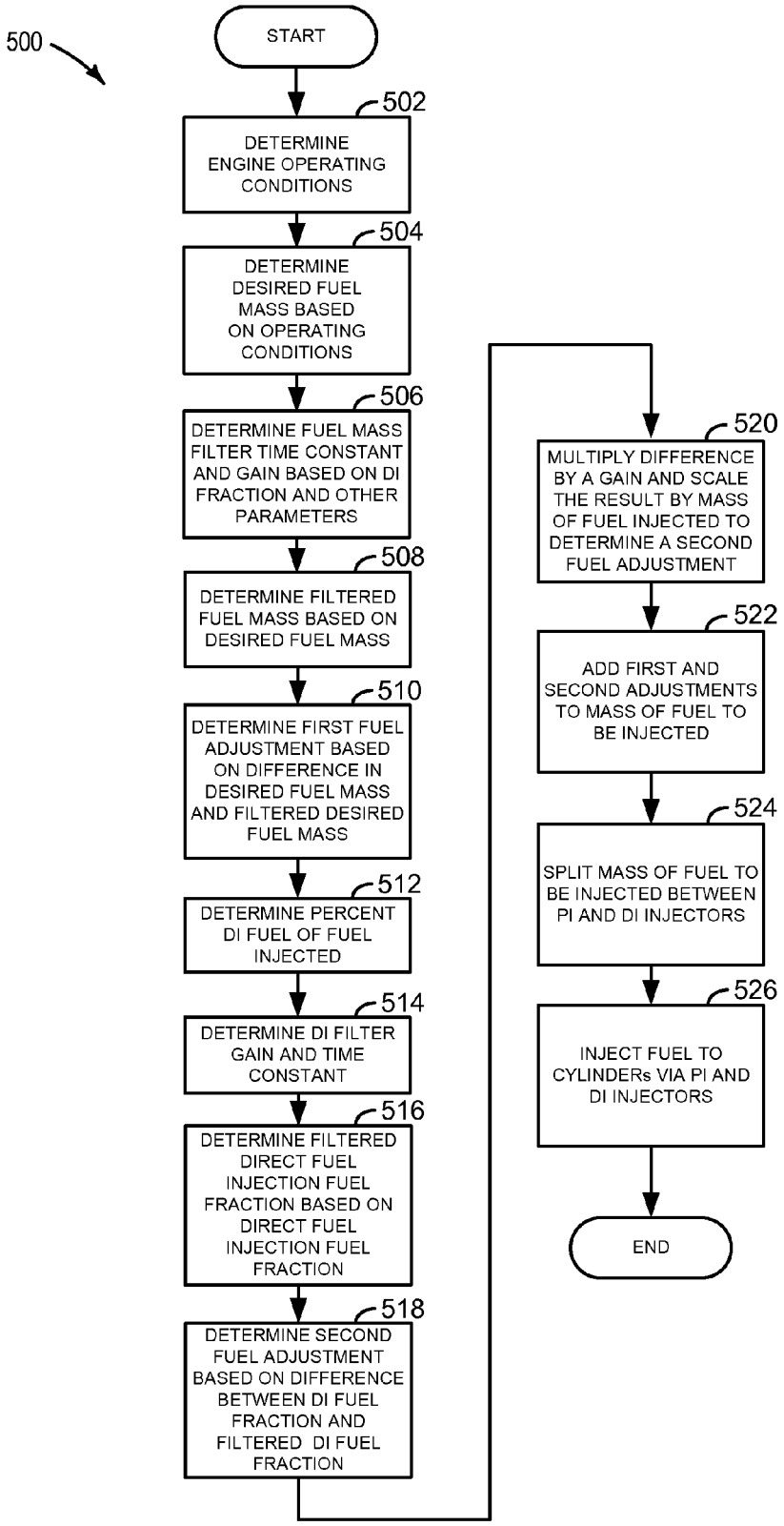
FIG. 5 shows an example method for adjusting fuel during transient engine operating conditions.

The following description relates to systems and methods for adjusting fuel supplied to an engine during transient engine operating conditions. FIG. 1 shows an example engine that includes port and direct fuel injectors. An example table storing empirically determined port and direct fuel injection fractions is shown in FIG. 2. A simulated example engine operating sequence showing transient fuel adjustments is shown in FIG. 3. FIG. 4 shows an example block diagram for adjusting fuel during transient engine operating conditions. An example method for adjusting fuel supplied to an engine during transient engine operating conditions is shown in FIG. 5.

Referring now to FIG. 1, a schematic diagram showing one cylinder of a multi-cylinder engine 10 is shown. Engine 10 may be controlled at least partially by a control system including a controller 12 and by input from a vehicle operator 182 via an input device 180. In this example, the input device 180 includes an accelerator pedal and a pedal position sensor 184 for generating a proportional pedal position signal.

A combustion chamber 32 of the engine 10 may include a cylinder formed by cylinder walls 34 with a piston 36 positioned therein. The piston 36 may be coupled to a crankshaft 40 so that reciprocating motion of the piston is translated into rotational motion of the crankshaft. The crankshaft 40 may be coupled to at least one drive wheel of a vehicle via an intermediate transmission system. Further, a starter motor may be coupled to the crankshaft 40 via a flywheel to enable a starting operation of engine 10.

Combustion chamber 32 may receive intake air from an intake manifold 44 via an intake passage 42 and may exhaust combustion gases via an exhaust passage 48. The intake manifold 44 and the exhaust passage 48 can selectively communicate with the combustion chamber 32 via respective intake valve 52 and exhaust valve 54. In some examples, the combustion chamber 32 may include two or more intake valves and/or two or more exhaust valves.

In this example, the intake valve 52 and exhaust valve 54 may be controlled by cam actuation via respective cam actuation systems 51 and 53. The cam actuation systems 51 and 53 may each include one or more cams and may utilize one or more of cam profile switching (CPS), variable cam timing (VCT), variable valve timing (VVT), and/or variable valve lift (VVL) systems that may be operated by the controller 12 to vary valve operation. The position of the intake valve 52 and exhaust valve 54 may be determined by position sensors 55 and 57, respectively. In alternative examples, the intake valve 52 and/or exhaust valve 54 may be controlled by electric valve actuation. For example, the cylinder 32 may alternatively include an intake valve controlled via electric valve actuation and an exhaust valve controlled via cam actuation including CPS and/or VCT systems.

A direct fuel injector 69 is shown coupled directly to combustion chamber 32 for injecting fuel directly therein in proportion to the pulse width of a signal received from the controller 12. In this manner, the direct fuel injector 69 provides what is known as direct injection of fuel into the combustion chamber 32. The fuel injector may be mounted in the side of the combustion chamber or in the top of the combustion chamber, for example. Fuel may be delivered to the fuel injector 69 by a fuel system (not shown) including a fuel tank, a fuel pump, and a fuel rail. In some examples, the combustion chamber 32 is also supplied fuel via port fuel injector 67. Port fuel injector 67 is arranged in the intake manifold 344 in a configuration such that it provides what is known as port injection of fuel into the intake port upstream of the combustion chamber 32.

Spark is provided to combustion chamber 32 via spark plug 66. The ignition system may further comprise an ignition coil (not shown) for increasing voltage supplied to spark plug 66. In other examples, such as a diesel, spark plug 66 may be omitted.

The intake passage 42 may include a throttle 62 having a throttle plate 64. In this particular example, the position of throttle plate 64 may be varied by the controller 12 via a signal provided to an electric motor or actuator included with the throttle 62, a configuration that is commonly referred to as electronic throttle control (ETC). In this manner, the throttle 62 may be operated to vary the intake air provided to the combustion chamber 32 among other engine cylinders. The position of the throttle plate 64 may be provided to the controller 12 by a throttle position signal. The intake passage 42 may include a mass air flow sensor 120 and a manifold air pressure sensor 122 for sensing an amount of air entering engine 330.

An exhaust gas sensor 127 is shown coupled to the exhaust passage 48 upstream of an emission control device 70 according to a direction of exhaust flow. The sensor 127 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a $NO_x$, HC, or CO sensor. In one example, upstream exhaust gas sensor 127 is a UEGO configured to provide output, such as a voltage signal, that is proportional to the amount of oxygen present in the exhaust. Controller 12 converts oxygen sensor output into exhaust gas air-fuel ratio via an oxygen sensor transfer function.

The emission control device 70 is shown arranged along the exhaust passage 48 downstream of the exhaust gas sensor 127. The device 70 may be a three way catalyst (TWC), $NO_x$ trap, various other emission control devices, or combinations thereof. In some examples, during operation of the engine 10, the emission control device 70 may be periodically reset by operating at least one cylinder of the engine within a particular air-fuel ratio.

The controller 12 is shown in FIG. 1 as a microcomputer, including a microprocessor unit 102, input/output ports 104, an electronic storage medium for executable programs and calibration values shown as read only memory chip 106 (e.g., non-transitory memory) in this particular example, random access memory 108, keep alive memory 110, and a data bus. The controller 112 may receive various signals from sensors coupled to the engine 10, in addition to those signals previously discussed, including measurement of inducted mass air flow (MAF) from the mass air flow sensor 120; engine coolant temperature (ECT) from a temperature sensor 123 coupled to a cooling sleeve 114; an engine position signal from a Hall effect sensor 118 (or other type) sensing a position of crankshaft 140; throttle position from a throttle position sensor 165; and manifold absolute pressure (MAP) signal from the sensor 122. An engine speed signal may be generated by the controller 12 from crankshaft position sensor 118. Manifold pressure signal also provides an indication of vacuum, or pressure, in the intake manifold 44. Note that various combinations of the above sensors may be used, such as a MAF sensor without a MAP sensor, or vice versa. During engine operation, engine torque may be inferred from the output of MAP sensor 122 and engine speed. Further, this sensor, along with the detected engine speed, may be a basis for estimating charge (including air) inducted into the cylinder. In one example, the crankshaft position sensor 118, which is also used as an engine speed sensor, may produce a predetermined number of equally spaced pulses every revolution of the crankshaft.

The storage medium read-only memory 106 can be programmed with computer readable data representing non-transitory instructions executable by the processor 102 for performing the methods described below as well as other variants that are anticipated but not specifically listed.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 32 via intake manifold 44, and piston 36 moves to the bottom of the cylinder so as to increase the volume within combustion chamber 32. The position at which piston 36 is near the bottom of the cylinder and at the end of its stroke (e.g., when combustion chamber 32 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 32. The point at which piston 36 is at the end of its stroke and closest to the cylinder head (e.g., when combustion chamber 32 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 66, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

As described above, FIG. 1 shows only one cylinder of a multi-cylinder engine, and each cylinder may similarly include its own set of intake/exhaust valves, fuel injector, spark plug, etc.

Thus, the system of FIG. 1 provides for an engine system, comprising: an engine including port and direct fuel injectors; and a controller including non-transitory instructions for adjusting fuel supplied via the port and direct fuel injectors to the engine, the adjusting including adjusting an amount of fuel injected to the engine in response to a difference between a direct fuel injection fuel fraction and a filtered direct fuel injection fuel fraction. The system further comprises additional instructions to adjust fuel supplied via the port and direct fuel injectors in response to a difference between a desired fuel injection mass and a filtered desired fuel injection mass. The system further comprises additional instruction to multiply the difference by a gain that is based on engine coolant temperature and intake manifold pressure. The system further comprises additional instructions to multiply the difference by a mass of fuel, the mass of fuel based on engine speed and torque. The system further comprises additional instructions to determine a fuel fraction injected by the direct fuel injectors. The system includes where the amount of fuel injected via the direct fuel injectors is based on the fuel fraction.

Referring now to FIG. 2, a table for determining port and direct fuel injector fuel fractions for a total amount of fuel supplied to an engine during an engine cycle is shown. The table of FIG. 2 may be a basis for determining a direct fuel injector fuel fraction as described in the method of FIG. 5. The vertical axis represents engine speed and engine speeds are identified along the vertical axis. The horizontal axis represents engine load and engine load values are identified along the horizontal axis. In this example, table cells 200 include two values separated by a comma. Values to the left sides of the commas represent port fuel injector fuel fractions and values to the right sides of commas represent direct fuel injector fuel fractions. For example, for the table value corresponding to 2000 RPM and 0.2 load holds empirically determined values 0.4 and 0.6. The value of 0.4 or 40% is the port fuel injector fuel fraction, and the value 0.6 or 60% is the direct fuel injector fuel fraction. Consequently, if the desired fuel injection mass is 1 gram of fuel during an engine cycle, 0.4 grams of fuel is port injected fuel and 0.6 grams of fuel is direct injected fuel. In other examples, the table may only contain a single value at each table cell and the corresponding value may be determined by subtracting the value in the table from a value of one. For example, if the 2000 RPM and 0.2 load table cell contains a single value of 0.6 for a direct injector fuel fraction, then the port injector fuel fraction is 1−0.6=0.4.

It may be observed in this example that the port fuel injection fraction is greatest at lower engine speeds and loads. The direct fuel injection fraction is greatest at middle level engine speeds and loads. The port fuel injection fraction increases at higher engine speeds where the time to inject fuel directly to a cylinder may be reduced because of a shortening of time between cylinder combustion events. It may be observed that if engine speed changes without a change in engine load, the port and direct fuel injection fractions may change.

Referring now to FIG. 3, an example sequence of transient fuel control according to the method of FIG. 5 is shown. The sequence may be provided in the system of FIG. 1. Vertical markers at time T1 and time T2 represent times of interest during the sequence.

The first plot from the top of FIG. 3 is a plot of engine speed versus time. The vertical axis represents engine speed and engine speed increases in the direction of the vertical axis arrow. The horizontal axis represents time and time increases from the left side of the plot to the right side of the plot.

The second plot from the top of FIG. 3 is a plot of engine load versus time. The vertical axis represents engine load and engine load (e.g., cylinder air charge divided by theoretical maximum cylinder air charge) increases in the direction of the vertical axis arrow. The horizontal axis represents time and time increases from the left side of the plot to the right side of the plot.

The third plot from the top of FIG. 3 is a plot of total mass of fuel injected to an engine during an engine cycle versus time. The vertical axis represents total mass of fuel injected to an engine during an engine cycle and the total mass of fuel injected increases in the direction of the vertical axis arrow. The horizontal axis represents time and time increases from the left side of the plot to the right side of the plot.

The fourth plot from the top of FIG. 3 is a plot of mass of port fuel injected during a cylinder cycle versus time. The vertical axis represents mass of port fuel injected during a cylinder cycle and mass of port fuel injected during a cylinder cycle increases in the direction of the vertical axis arrow. The horizontal axis represents time and time increases from the left side of the plot to the right side of the plot.

The fifth plot from the top of FIG. 3 is a plot of mass of direct fuel injected during a cylinder cycle versus time. The vertical axis represents mass of direct fuel injected during a cylinder cycle and mass of direct fuel injected during a cylinder cycle increases in the direction of the vertical axis arrow. The horizontal axis represents time and time increases from the left side of the plot to the right side of the plot.

The mass of port fuel injected during an engine cycle added to the mass of direct fuel injected during an engine cycle is equal to the total mass of fuel injected during an engine cycle. Each of the five plots occurs at a same time as the other plots.

At time T0, engine speed is gradually increasing in response to a driver torque demand (not shown). The engine load is constant and the total mass of fuel injected during an engine cycle is constant. The mass of port injected fuel and the mass of direct injected fuel are also constant. The engine speed gradually increases until time T1.

At time T1, a transmission (not shown) coupled to the engine upshifts from a lower gear to a higher gear (e.g., from first gear to second gear). Consequently, engine speed is reduced without the driver changing the driver demand torque. The engine load remains constant since the driver demand torque has not changed. The total mass of fuel which may be based on driver demand torque also remains at a constant value. However, the fraction of port fuel injection and the fraction of direct fuel injection change in response to the change in engine speed. In particular, the fraction of port fuel injection is increased and the fraction of direct fuel injection is decreased. The change in port and direct fuel injection fractions causes a change in port fuel puddle mass. In particular, the port fuel puddle mass increases so that transient fuel compensation provides additional fuel to engine cylinders via port fuel injectors and reduces fuel to engine cylinders via direct fuel injectors. By increasing the amount of fuel injected via port fuel injectors, the amount of fuel entering the cylinder via port fuel injectors is a desired amount of fuel entering the cylinder via the port fuel injector. The additional amount of fuel goes into increasing the fuel puddle mass, thereby reducing the possibility of engine air-fuel errors related to port fuel injection. The amount of direct fuel injection is decreased so that the total amount of fuel injected remains the same. However, in some examples, the total amount of fuel may be increased for a period of time (e.g., duration corresponding to a time constant) to reflect addition of fuel to the engine intake port fuel puddle.

Between time T1 and time T2, the engine speed gradually increases as the vehicle accelerates. Also, the mass of port injected fuel decreases even though the engine load and total mass of fuel injected remain constant. The mass of direct fuel injected to the engine increases as the mass of port fuel injected decreases to offset the decrease in port injected fuel.

At time T2, the engine load is reduced in response to a driver reducing a driver demand torque (not shown). The engine speed remains constant since the vehicle is no longer accelerating due to the reduction in driver demand torque. The change in driver demand torque and engine load cause a reduction in the total mass of fuel injected to the engine. Consequently, the fraction of port fuel injected increases as indicated by the mass of port fuel injected to the cylinder increasing. The mass of port fuel injected increases to a value greater than would be injected to the engine at the same steady state engine load so that the fuel puddle in the intake port may be established to a level appropriate for the new engine load. The mass of direct fuel injected is decreased to offset the increase in port injected fuel, thereby compensating for the increase in port injected fuel. The increase in port injected fuel lasts for a predetermined amount of time based on a time constant of a transient fuel filter and then the port injected fuel mass reaches a steady state value that corresponds to the port fuel injection fraction and the total fuel mass injected to the cylinder.

In this way, amounts of port injected fuel and direct injected fuel may be adjusted to compensate for fuel entering fuel puddles and increasing fuel puddle mass in the intake manifold and fuel exiting fuel puddles and decreasing fuel puddle mass in the intake manifold. Compensating the port fuel injection amount and the direct fuel injection amount may provide improved air-fuel control during transient engine operating conditions.

Referring now to FIG. 4, a block diagram 400 is a control block diagram for describing port fuel injection fuel compensation and direct fuel injection fuel compensation for an engine operating during transient or changing operating conditions.

A desired fuel mass is input to summing junction 402 and filter 406. The desired fuel mass may be based on engine speed and driver demand torque. In addition, feedback air-fuel ratio adjustments from exhaust gas oxygen sensors (e.g., sensor 127) may be added to the desired fuel mass. For example, an error between a desired air-fuel ratio and a measured air-fuel ratio from the sensor may be processed by a control algorithm such as a proportional/integral algorithm to generate a feedback adjustment to the desired fuel mass. In this way, the air-fuel ratio feedback is independent from effects of changes in the DI fraction and improved control can be achieved. In other words, negative feedback interactions (such as the feed-forward adjustment described herein based on changes in DI fraction being countered by feedback corrections) can be reduced since the DI fraction is not directly adjusted based on any air-fuel ratio feedback adjustment. Rather, only through the desired fuel mass does the air-fuel ratio feedback correction actually adjust the amount of fuel injected.

The driver demand torque may be based on accelerator pedal position and vehicle speed. Manifold absolute pressure (MAP), time since engine start, engine intake and exhaust valve timing, valve temperature, engine speed, volatility of fuel being combusted in the engine, engine fuel consumption, engine temperature, fuel temperature, and direct injection (DI) fuel fraction are input into block 404. At block 404, a first filter time constant and gain are determined based on the parameters input to block 404. In one example, the parameters index tables and/or functions of empirically determined values, that when combined, output a filter gain and time constant. The filter gain and time constant are input to block 406.

At block 406, the desired fuel mass is filtered. The filter may have a form of a first order low pass filter. Block 406 outputs the filtered fuel mass to summing junction 402 where the filtered desired fuel mass is subtracted from the desired fuel mass. The resulting fuel mass is directed to summing junction 410.

A direct injection (DI) fuel fraction is input to summing junction 424 and filter 422. The direct injection fuel fraction may be determined via a look up table as is shown in FIG. 2. In one example, the direct fuel fraction is based on engine speed and engine load or torque. Engine intake manifold pressure, engine temperature, and direct fuel injection fuel fraction are input to block 420 where a gain and time constant for a second filter are determined. In one example, the parameters index tables and/or functions of empirically determined values, that when combined, output the filter gain and time constant. The filter gain and time constant are input to block 422.

At block 422, the direct fuel injection fuel fraction is filtered. The filter may have a form of a first order low pass filter. Block 422 outputs the filtered direct fuel injection fuel fraction to summing junction 424 where the filtered direct fuel injection fuel fraction is subtracted from the direct fuel injection fuel fraction. The resulting direct fuel injection fuel fraction is directed to block 426 where it is multiplied by a gain. In one example, the gain is an empirically determined value that is indexed by and varies with engine coolant temperature and engine intake manifold pressure. The output of block 426 is directed to multiplication junction 428 where it is multiplied and scaled by the desired fuel mass. The output of multiplication junction 428 is added to the output of summing junction 402 at summing junction 410. Finally, the output of summing junction is output to summing junction 412 where it is added to the desired fuel mass to provide a mass of fuel injected to the engine cylinders. Thus, the mass of fuel injected to engine cylinders is the desired fuel mass plus a fuel mass based on the direct fuel injection fuel fraction and a mass of fuel based on the filtered desired fuel mass. At block 408, the mass of fuel injected is output to engine cylinders via port and direct fuel injectors. The port fuel injection fraction and the direct fuel injection fraction determine the mass of fuel injected to the engine via the respective port and direct fuel injectors.

Referring now to FIG. 5, a method for adjusting an amount of fuel supplied to an engine is shown. The method of FIG. 5 may increase or decrease a base amount or desired fuel amount supplied to engine cylinders to compensate for fuel increasing mass of an engine intake port puddle or fuel decreasing mass of the engine intake port puddle. Further, during some conditions, the method may increase or decrease the desired fuel amount to compensate for fuel increasing or decreasing a mass of a fuel puddle in an engine cylinder due to direct fuel injection. At least portions of the method of FIG. 5 may be incorporated as executable instructions stored in non-transitory memory. Further, portions of the method of FIG. 5 may be actions taken by the controller in the physical world to transform fuel injector operation.

At 502, method 500 determines engine operating conditions. Engine operating conditions may be determined via receiving data from sensors and actuators in the engine and vehicle system. Engine operating conditions may include but are not limited to engine speed, driver demand torque, engine load, engine coolant temperature, engine intake manifold pressure, time since start, valve timing, fuel volatility, and fuel temperature. Further, vehicle operating conditions such as vehicle speed may be determined at 502. Method 500 proceeds to 504 after engine operating conditions are determined.

At 504, method 500 determines a desired fuel mass based on operating conditions. In one example, the desired fuel mass is empirically determined and stored in a table based on engine speed and driver demand torque. The table is indexed via engine speed and driver demand torque. In other examples, the desired fuel mass is based on an amount of air entering the engine and a desired engine air-fuel ratio. The desired fuel mass is determined for each engine cylinder. Method 500 proceeds to 506 after determining the desired fuel mass.

At 506, method 500 determines a desired fuel mass time constant and gain. The time constant represents a number of engine cycles it takes for the intake manifold fuel puddle mass to reach an equilibrium fuel puddle mass after a change in engine operating conditions (e.g., speed and load). The gain represents the magnitude change in fuel mass entering or exiting the fuel puddle that is responsive to the change in operating conditions. In one example, the time constant and gain are empirically determined and stored in tables and/or functions that are indexed based on engine intake manifold pressure, time since start, valve timing, valve temperature, engine speed, fuel consumption, fuel volatility, engine coolant temperature, fuel temperature, and direct fuel injector fuel fraction. The tables and/or functions output the desired fuel mass time constant and gain. Method 500 proceeds to 508 after the desired fuel mass time constant and gain are determined.

At 508, method 500 determines a filtered desired fuel mass based on the desired fuel mass. In particular, the gain and time constant determined at 506 are parameters of a low pass filter, the desired fuel mass is input to the low pass filter, and the low pass filter outputs the filtered desired fuel mass. Method 500 proceeds to 510 after filtering the desired fuel mass.

At 510, method 500 determines a first fuel adjustment based on the filtered desired fuel mass. In particular, the filtered fuel mass is subtracted from the desired fuel mass to determine the first fuel adjustment. Method 500 proceeds to 512 after the first fuel adjustment is determined.

At 512, method 500 determines a direct injection (DI) fuel fraction of a total amount of fuel supplied to the engine. In one example, the direct injection fuel fraction is empirically determined and stored to a table as shown and described in FIG. 2. The table is indexed by engine speed and load or torque and the table output the direct injection fuel fraction. Method 500 proceeds to 514 after the direct injection fuel fraction is determined.

At 514, method 500 determines a direct fuel injection fuel fraction time constant and gain. The time constant represents a number of engine cycles it takes for the intake manifold fuel puddle mass to reach an equilibrium fuel puddle mass after a change in direct injection fuel fraction. The gain represents the magnitude change in fuel mass entering or exiting the fuel puddle that is responsive to the change in direct injection fuel fraction. In one example, the time constant and gain are empirically determined and stored in tables and/or functions that are indexed based on engine intake manifold pressure, engine speed, fuel consumption, engine coolant temperature, and direct injection fuel fraction. The tables and/or functions output the desired direct fuel injection fuel fraction time constant and gain. Method 500 proceeds to 516 after the direct injection fuel fraction time constant and gain are determined.

At 516, method 500 determines a filtered direct fuel injection fuel fraction based on the direct fuel injection fuel fraction. In particular, the gain and time constant determined at 514 are parameters of a low pass filter, the direct fuel injection fuel fraction is input to the low pass filter, and the low pass filter outputs the filtered direct fuel injection fuel fraction. Method 500 proceeds to 518 after filtering the direct fuel injection fuel fraction.

At 518, method 500 determines a difference between the filtered direct fuel injection fuel fraction and the direct fuel injection fuel fraction. In particular, the filtered direct fuel injection fuel fraction is subtracted from the direct fuel injection fuel fraction. Method 500 proceeds to 520 after the difference is determined.

At 520, method 500 multiplies the difference determined at 518 by a gain and the mass of fuel injected to determine a second fuel adjustment. In one example, the gain is empirically determined based on engine coolant temperature, direct fuel injection fuel fraction, engine speed, and engine intake manifold pressure. The gain values stored in memory are indexed based on engine coolant temperature, direct fuel injection fuel fraction, engine speed, and engine intake manifold pressure. Method 500 proceeds to 522 after the second fuel adjustment is determined.

At 522, method 500 adds the first fuel adjustment from 510 and the second fuel adjustment from 520 together. Further, the first and second fuel adjustments are added to the desired fuel mass determined at 504 for each engine cylinder to determine the amount of fuel to inject to each engine cylinder. The first and second fuel adjustments may be described as transient fuel adjustments. Method 500 proceeds to 524 after determining the fuel amounts for each engine cylinder.

At 524, method 500 determines how the fuel allocated to each cylinder is to be delivered via port and direct fuel injectors. Specifically, method 500 indexes tables or function as described at FIG. 2 and multiplies the fuel amount for each cylinder determined at 522 by the direct fuel injection fuel fraction. For example, if the fuel amount for a cylinder determined at 522 is 0.05 grams and the direct fuel injection fuel fraction is 0.3, then the amount of fuel injected by the cylinder's direct fuel injector is 0.015. The remaining 0.035 grams of fuel in the total amount of fuel to be injected to the cylinder as determined at 522 is injected via the port fuel injector. In this way, the total amount of fuel injected to a cylinder is allocated between direct and port fuel injectors. Method 500 proceeds to 526 after fuel is allocated between direct and port fuel injectors for engine cylinders.

At 526, method 500 delivers the direct fuel injection fuel amount and port fuel injection fuel amounts determined at 524 to engine cylinders via opening port and direct fuel injectors. The fuel injectors may be configured as shown in FIG. 1. Method 500 proceeds to exit after fuel is injected to engine cylinders via direct and port fuel injectors.

Thus, the method of FIG. 5 provides for an engine fueling method, comprising: retrieving engine operating information from sensors; adjusting a direct fuel injection fuel fraction of a total amount of fuel injected based on the engine operating information; filtering the direct fuel injection fuel fraction; and adjusting an amount of fuel injected in response to a difference between the direct fuel injection fuel fraction and the filtered direct fuel injection fuel fraction. The method includes where the difference is further multiplied by a gain that is based on engine coolant temperature and intake manifold pressure. The method includes where the difference is further multiplied by a mass of fuel, the mass of fuel based on engine speed and torque. The method includes where the total amount of fuel injected is a sum of a mass of port injected fuel and mass of directly injected fuel during an engine cycle. The method includes where the direct fuel injection fuel fraction is the mass of directly injected fuel divided by a mass of the total amount of fuel injected during the engine cycle. The method includes where the direct fuel injection fuel fraction varies with engine speed.

The method of FIG. 5 also provides for an engine fueling method, comprising: retrieving engine operating information from sensors; adjusting a direct fuel injection fuel fraction of a total amount of fuel injected and a desired fuel injection mass based on the engine operating information; filtering the direct fuel injection fuel fraction and the desired fuel injection mass; and adjusting an amount of fuel injected in response to a difference between the direct fuel injection fuel fraction and the filtered direct fuel injection fuel fraction, and further adjusting the amount of fuel injected in response to a difference between the desired fuel injection mass and the filtered desired fuel injection mass. The method further comprises adjusting the amount of fuel injected in response to a sum of the desired fuel injection mass and the difference between the desired fuel injection mass and the filtered desired fuel injection mass. The method further comprises determining a time constant and a gain for a filter that is applied to the direct fuel injection fuel fraction based on the direct fuel injection fuel fraction.

In some examples, the method further comprises determining a time constant for a filter that is applied to the desired fuel injection mass based on the direct fuel injection fuel fraction. The method further comprises delivering the adjusted amount of fuel injected via port and direct fuel injectors. The method includes where the adjusted amount of fuel injected via the port and direct fuel injectors is based on the direct fuel injection fuel fraction. The method includes where the difference between the direct fuel injection fuel fraction and the filtered direct fuel injection fuel fraction is further multiplied by a gain that is based on engine coolant temperature and intake manifold pressure. The method includes where the difference between the direct fuel injection fuel fraction and the filtered direct fuel injection fuel fraction is further multiplied by a mass of fuel based on engine speed and torque.

In another representation, an engine fueling method, comprises adjusting a desired fuel mass based on feedback from an exhaust gas oxygen sensor, determining a direct fuel injection fuel fraction of a total amount of fuel injected to a cylinder based on the adjusted desired fuel mass but not further adjusted based on the feedback, and delivering injected fuel by a port and direct injector based on a filtered direct fuel injection fuel fraction. In addition, the method may include retrieving engine operating information from sensors; adjusting the direct fuel injection fuel fraction of the total amount of fuel injected to a cylinder based on the engine operating information; filtering the direct fuel injection fuel fraction; and adjusting the total amount of fuel injected to the cylinder in response to a difference between the direct fuel injection fuel fraction and the filtered direct fuel injection fuel fraction.

Note that the example control and estimation routines included herein can be used with various engine and/or vehicle system configurations. Further, the methods described herein may be a combination of actions taken by a controller in the physical world and instructions within the controller. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The following claims particularly point out certain combinations and sub-combinations regarded as novel and nonobvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine fueling method, comprising:

retrieving engine operating information from sensors;

adjusting a direct fuel injection fuel fraction of a total amount of fuel injected to a cylinder based on the engine operating information;

filtering the direct fuel injection fuel fraction with a low pass filter; and adjusting the total amount of fuel injected to the cylinder in response to a difference between the direct fuel injection fuel fraction and the filtered direct fuel injection fuel fraction, where the total amount of fuel injected is a sum of a mass of port injected fuel to the cylinder and a mass of directly injected fuel to the cylinder during an engine cycle, and where the direct fuel injection fuel fraction is the mass of directly injected fuel to the cylinder divided by a mass of the total amount of fuel injected to the cylinder during the engine cycle.

2. The method of claim 1, where the difference is multiplied by a desired mass of fuel, the desired mass of fuel based on engine speed and driver demand torque.

3. The method of claim 1, where the direct fuel injection fuel fraction varies with engine speed.

4. An engine fueling method, comprising:

retrieving engine operating information from sensors;

adjusting a direct fuel injection fuel fraction of a total amount of fuel injected to a cylinder and a desired fuel injection mass to the cylinder based on the engine operating information;

applying a low pass filter to the direct fuel injection fuel fraction and applying a low pass filter to the desired fuel injection mass;

adjusting an amount of fuel injected to the cylinder in response to a difference between the direct fuel injection fuel fraction and the filtered direct fuel injection fuel fraction, and further adjusting the amount of fuel injected to the cylinder in response to a difference between the desired fuel injection mass and the filtered desired fuel injection mass; and determining a time constant and the low pass filter that is applied to the direct fuel injection fuel fraction based on the direct fuel injection fuel fraction.

5. The method of claim 4, further comprising adjusting the amount of fuel injected in response to a sum of the desired fuel injection mass and the difference between the desired fuel injection mass and the filtered desired fuel injection mass.

6. The method of claim 4, further comprising determining a time constant for a filter that is applied to the desired fuel injection mass based on the direct fuel injection fuel fraction.

7. The method of claim 4, further comprising delivering the adjusted amount of fuel injected via port and direct fuel injectors.

8. The method of claim 7, where the adjusted amount of fuel injected via the port and direct fuel injectors is based on the direct fuel injection fuel fraction.

9. The method of claim 4, where the difference between the direct fuel injection fuel fraction and the filtered direct fuel injection fuel fraction is further multiplied by the desired fuel injection mass, the desired fuel injection mass based on engine speed and driver demand torque.

10. An engine system, comprising:

an engine including port and direct fuel injectors; and a controller including non-transitory instructions for adjusting fuel supplied via the port and direct fuel injectors to the engine, the adjusting including adjusting an amount of fuel injected to the engine in response to a difference between a direct fuel injection fuel fraction and a filtered direct fuel injection fuel fraction, the direct fuel injection fuel fraction filtered with a low pass filter in order to determine the filtered direct fuel injection fuel fraction.

11. The system of claim 10, further comprising additional instructions to adjust fuel supplied via the port and direct fuel injectors in response to a difference between a desired fuel injection mass and a filtered desired fuel injection mass.

12. The system of claim 10, further comprising additional instructions to multiply the difference by a desired mass of fuel, the desired mass of fuel based on engine speed and driver demand torque.

13. The system of claim 10, further comprising additional instructions to determine a fuel fraction injected by the direct fuel injectors.

14. The system of claim 13, where the amount of fuel injected via the direct fuel injectors is based on the fuel fraction.

* * * * *